US008106721B2

(12) United States Patent
Tzuang et al.

(10) Patent No.: US 8,106,721 B2
(45) Date of Patent: Jan. 31, 2012

(54) MULTILAYER COMPLEMENTARY-CONDUCTING-STRIP TRANSMISSION LINE STRUCTURE WITH PLURAL INTERLACED SIGNAL LINES AND MESH GROUND PLANES

(75) Inventors: Ching-Kuang Tzuang, Taipei (TW); Meng-Ju Chiang, Taipei (TW); Shian-Shun Wu, Taipei (TW)

(73) Assignees: National Taiwan University, Taipei (TW); CMSC, Inc., Hsinchu (TW)

( * ) Notice: Subject to any disclaimer, the term of this patent is extended or adjusted under 35 U.S.C. 154(b) by 135 days.

(21) Appl. No.: 12/507,973

(22) Filed: Jul. 23, 2009

(65) Prior Publication Data

US 2010/0109790 A1 May 6, 2010

(30) Foreign Application Priority Data

Nov. 4, 2008 (TW) ..... 97142455 A

(51) Int. Cl.
*H01P 3/08* (2006.01)

(52) U.S. Cl. ..... 333/1; 333/238; 333/33

(58) Field of Classification Search ..... 333/238, 333/246, 1, 33
See application file for complete search history.

(56) References Cited

U.S. PATENT DOCUMENTS

| | | | | |
|---|---|---|---|---|
| 5,408,053 | A * | 4/1995 | Young | 174/264 |
| 6,522,214 | B1 * | 2/2003 | Harju et al. | 333/1 |
| 6,624,729 | B2 * | 9/2003 | Wright et al. | 333/238 |
| 2007/0241844 | A1 * | 10/2007 | Kim et al. | 333/238 |

OTHER PUBLICATIONS

Meng-Ju Chiang, Hsien-Shun Wu, Ching-Kuang C. Tzuang, Ka-Band CMOS Hybrids Miniaturization Incorporating Multilayer Synthetic Quasi-TEM Transmission Lines, Oct. 28, 2008, 4 pages, Graduate Institute of Communication Engineering, National Taiwan University, Taipei, Taiwan.

* cited by examiner

*Primary Examiner* — Benny Lee
(74) *Attorney, Agent, or Firm* — WPAT, PC; Justin King

(57) ABSTRACT

A multilayer complementary-conducting-strip transmission line (CCS TL) structure is disclosed herein. The multilayer CCS TL structure includes a substrate, and n signal transmission lines being parallel and interlacing with n-1 mesh ground plane(s), therein a plurality of inter-media-dielectric (IMD) layers are correspondingly stacked with among the n signal transmission lines and the n-1 mesh ground plane(s) to form a stack structure on the substrate, therein n≧2 and n is a natural number. Whereby, a multilayer CCS TL with independent of each layer and complete effect on signal shield is formed to provide more flexible for circuit design, reduce the circuit area and also diminish the transmission loss.

17 Claims, 5 Drawing Sheets

MULTILAYER COMPLEMENTARY-CONDUCTING-STRIP TRANSMISSION LINE STRUCTURE WITH PLURAL INTERLACED SIGNAL LINES AND MESH GROUND PLANES

BACKGROUND OF THE INVENTION

1. Field of the Invention

This invention generally relates to the field of signal transmission line structure, and more particularly, to a multilayer complementary-conducting-strip transmission line (thereinafter called CCS TL) structure.

2. Description of the Prior Art

The successfully transmission-line-based (TL-based) hybrid designs for system-on-chip (SOC) integration are relied on for high-efficiency miniaturization. Numerous design techniques and circuit implementations had been reported and demonstrated for the desired circuit requirements. By either using capacitive loading (M. C. Scardelletti, G. E. Ponchak, and T. M. Weller, "Miniaturized Wilkinson power dividers utilizing capacitive loading," *IEEE Microwave Wireless Compon. Lett.*, vol. 12, no. 1, pp. 6-8, January 2002.) or inductive loading (K. Hettak, G. A. Morin, and M. G. Stubbs, "Compact MMIC CPW and asymmetric CPS branch-line coupler and Wilkinson dividers using shunt and series stub loading," *IEEE Trans. Microwave Theory and Tech.*, vol. 53, no. 5, pp. 1624-1635, May 2005.), the physical transmission line length in hybrid, coupler, and power divider designs can be reduced by at least 60%.

On the other hand, the well-published technique, so-called the 3-D MMIC technology (K. Nishikawa, T. Tokumitsu, and I. Toyoda, "Miniaturized Wilkinson power divider using three-dimensional MMIC technology," *IEEE Microwave Guided Wave Lett.*, vol. 6, no. 10, pp. 372-374, October 1996.; C. Y. Ng, M. Chongcheawchamnan, I. D. Robertson, "Lumped-distributed hybrids in 3D-MMIC technology," *IEEE Proc. -Microwave. Antennas and Propag.*, vol. 151, no. 4, pp. 370-374, August 2004.; I. Toyoda, T. Tokumitsu, and M. Ailawa, "Highly integrated three-dimensional MMIC single-chip receiver and transmitter," *IEEE Trans. Microwave Theory Tech.*, vol. 44, no. 12, pp. 2340-2346, December 1996.), has shown the fundamental breakthrough on multilayer transmission line implementations using GaAs technology. In the 3-D MMIC designs, the upper and lower lines are shielded by the intermedia metal with the slit. The size of the slit can be applied to control the coupling and characteristic impedances of two transmission lines. Such implementation had been widely applied to the 3-D miniaturized designs of power divider (K. Nishikawa, T. Tokumitsu, and I. Toyoda, "Miniaturized Wilkinson power divider using three-dimensional MMIC technology," *IEEE Microwave Guided Wave Lett.*, vol. 6, no. 10, pp. 372-374, October 1996.), hybrid (C. Y. Ng, M. Chongcheawchamnan, I. D. Robertson, "Lumped-distributed hybrids in 3D-MMIC technology," *IEEE Proc. -Microwave. Antennas and Propag.*, vol. 151, no. 4, pp. 370-374, August 2004.), and high-density integrated transceiver (I. Toyoda, T. Tokumitsu, and M. Ailawa, "Highly integrated three-dimensional MMIC single-chip receiver and transmitter," *IEEE Trans. Microwave Theory Tech.*, vol. 44, no. 12, pp. 2340-2346, December 1996.).

Recently, the multilayer design technique has been applied to microwave/millimeter-wave CMOS distributed passive components (M. Chirala, and C. Nguyen, "Multilayer Design Techniques for Extremely Miniaturized CMOS Microwave and Millimeter-Wave Distributed Passive Circuit," *IEEE Trans. Microwave Theory Tech.*, vol. 54, no. 12, pp. 4218-4224, December. 2006.). The microwave/millimeter-wave rat-race hybrid is designed by incorporating the multilayer microstrip lines. The reference ground plane is realized by the uniform bottom metal in CMOS processes. The signal traces can be arranged in the meandered-form and no extra shielding metal is inserted between upper and lower microstrip lines. Hence, between upper and lower microstrip lines, there has no any effective signal shield.

In view of the drawbacks mentioned with the prior art of signal transmission line, there is a continuous need to develop a new and improved multilayer CCS TL structure that overcomes the disadvantages associated with the prior art. The advantages of the present invention are that it solves the problems mentioned above.

SUMMARY OF THE INVENTION

In accordance with the present invention, a CCS TL structure substantially obviates one or more of the problems resulted from the limitations and disadvantages of the prior art mentioned in the background.

One of the purposes of the present invention is to change the characteristic impedance of a CCS TL by varying the slot size of the mesh ground plane in order to increase the flexibility and variety for circuit designs.

One of the purposes of the present invention is to isolate the CCS TL by mesh ground plane(s) in order to provide a complete signal shield and grounding.

One of the purposes of the present invention is to form a multilayer CCS TL with the character of independent and complete shielding for each layer by integrating the structures of multilayer CMOS and mesh ground planes in order to provide much flexibility for circuit designs, miniaturization, and less loss in signal transmission.

The present invention provides a multilayer CCS TL structure. The multilayer CCS TL structure includes a substrate, and n signal transmission lines being parallel and interlacing with n-1 mesh ground plane(s), herein a plurality of intermedia-dielectric (thereinafter called IMD) layers are correspondingly stacked with among the n signal transmission lines and the n-1 mesh ground plane(s) to form a stack structure on the substrate, herein n is a natural number and $n \geqq 2$.

The present invention offers a multilayer CCS TL structure. The multilayer CCS TL structure includes a first signal transmission line, a second signal transmission line being parallel with the first signal transmission line, a mesh ground plane being between the first and the second signal transmission lines, herein two IMD layers are sandwiched correspondingly among the mesh ground plane, the first and the second signal transmission lines to form a stack structure, and a substrate being beneath the stack structure.

The present invention provides a multilayer CCS TL structure. The multilayer CCS TL structure includes a substrate, a signal transmission line being above the substrate, and a mesh ground plane being between the substrate and the signal transmission line, herein two IMD layers are sandwiched respectively among the substrate, the mesh ground plane, and the transmission line.

The present invention offers a multilayer CCS TL structure. The multilayer CCS TL structure includes a substrate, a signal transmission line being on the substrate, and a mesh ground plane being above the signal transmission line, herein two IMD layers are sandwiched respectively between the mesh ground plane and the signal transmission line and on the mesh ground plane.

BRIEF DESCRIPTION OF THE DRAWINGS

The accompanying drawings incorporated in and forming a part of the specification illustrate several aspects of the present invention, and together with the description serve to explain the principles of the disclosure. In the drawings.

DETAILED DESCRIPTION OF THE PREFERRED EMBODIMENTS

Some embodiments of the present invention will now be described in greater detail. Nevertheless, it should be noted that the present invention can be practiced in a wide range of other embodiments besides those explicitly described, and the scope of the present invention is expressly not limited except as specified in the accompanying claims.

Moreover, some irrelevant details are not drawn in order to make the illustrations concise and to provide a clear description for easily understanding the present invention.

Figure 1:
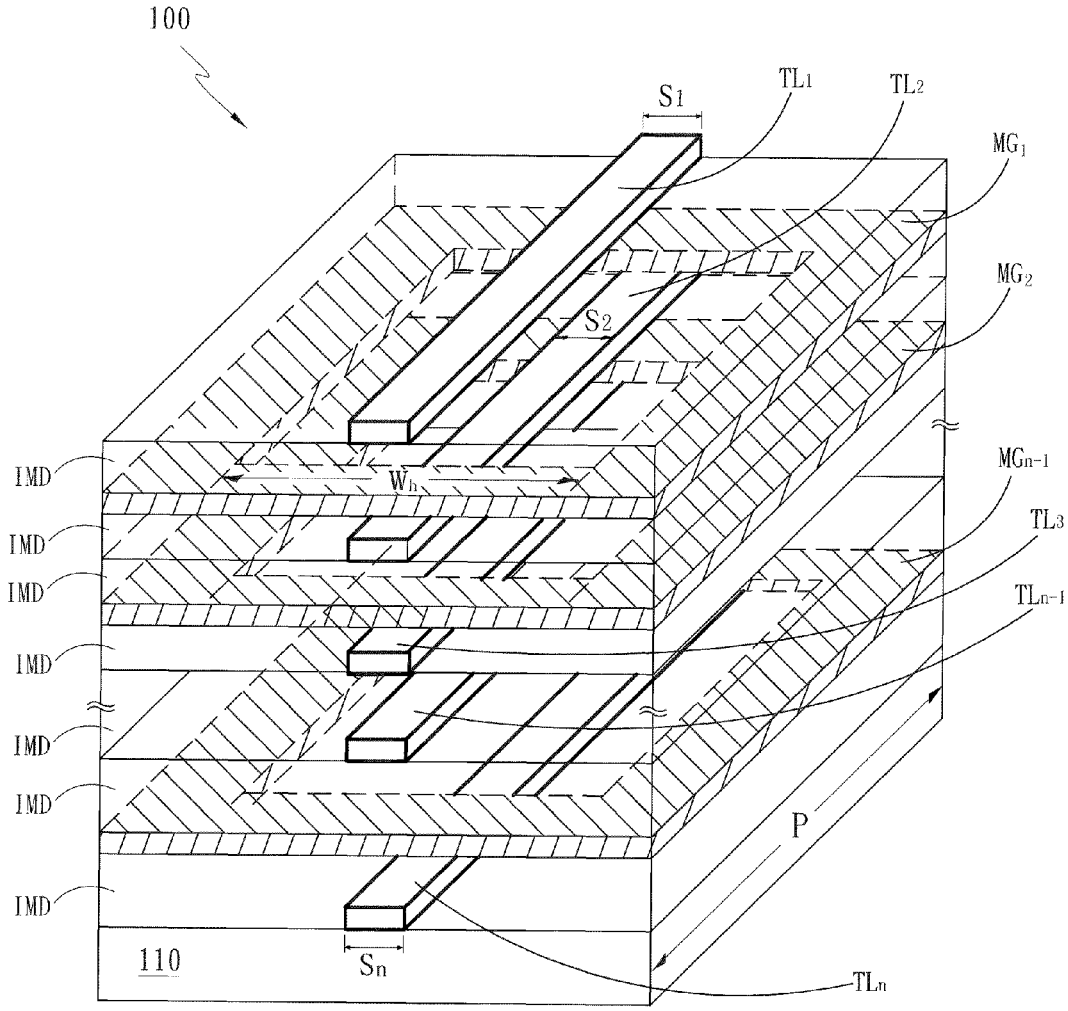
FIG. 1 illustrates the three-dimensional perspective structure of one preferred embodiment in accordance with the present invention.

Referring to FIG. 1, the three-dimensional perspective structure of one preferred embodiment 100 in accordance with the present invention is illustrated. A substrate 110 has a size P (also called a periodicity P). n signal transmission lines $TL_1$, $TL_2$, . . . , and $TL_n$ are parallel and interlace with n−1 mesh ground planes $MG_1$, $MG_2$, . . . , and $MG_{n-1}$ (not shown), that is, the mesh ground planes $MG_1$ is between the signal transmission lines $TL_1$ and $TL_2$, the mesh ground planes $MG_2$ is between the signal transmission lines $TL_2$ and $TL_3$, . . . , and the mesh ground plane $MG_{n-1}$ is between the signal transmission lines $TL_{n-1}$ and $TL_n$. Herein, a plurality of inter-media-dielectric (thereinafter called IMD) layers IMD are correspondingly stacked with among the n signal transmission lines $TL_1$, $TL_2$, . . . , and $TL_n$ and the n−1 mesh ground planes $MG_1$, $MG_2$, . . . , and $MG_{n-1}$ (for example, an IMD layer IMD is between the signal transmission line $TL_1$ and the mesh ground plane $MG_1$, another IMD layer IMD is between the mesh ground plane $MG_1$ and the signal transmission line $TL_2$, . . . , and still another IMD layer IMD is between the mesh ground plane $MG_{n-1}$ and the signal transmission line $TL_n$) to form a stack structure on the substrate 110, wherein n is a natural number and $n \geqq 2$. The n signal transmission lines $TL_1$, $TL_2$, . . . , and $TL_n$ include straight-line form and the widths thereof refer to $S_1$, $S_2$, . . . , and $S_n$, respectively.

In the present embodiment, each mesh ground plane, such as $MG_1$, $MG_2$, . . . , and $MG_{n-1}$, is a metal layer with an inner slot, and the size of the inner slot is defined by mesh slot $W_h$. In the present embodiment, the n signal transmission lines $TL_1$, $TL_2$, . . . , and $TL_n$ are independent and have complete effect on signal shield in order to provide much flexibility for circuit designs, miniaturization, and less loss in signal transmission. Besides, the word "parallel" in the present embodiment is the concept of planes being parallel in space, and hence the n signal transmission lines $TL_1$, $TL_2$, . . . , and $TL_n$ are not limited to the same direction. That is, they also could be parallel but have any degree in direction, such as 90 degree. The inventor would like to emphasize that the geometric shape for the substrate 110, the mesh ground planes $MG_1$, $MG_2$, . . . , and $MG_{n-1}$, and the IMD layer IMD can be varied in shapes, and should not be limited to the square shape shown in the present embodiment.

Figure 2:
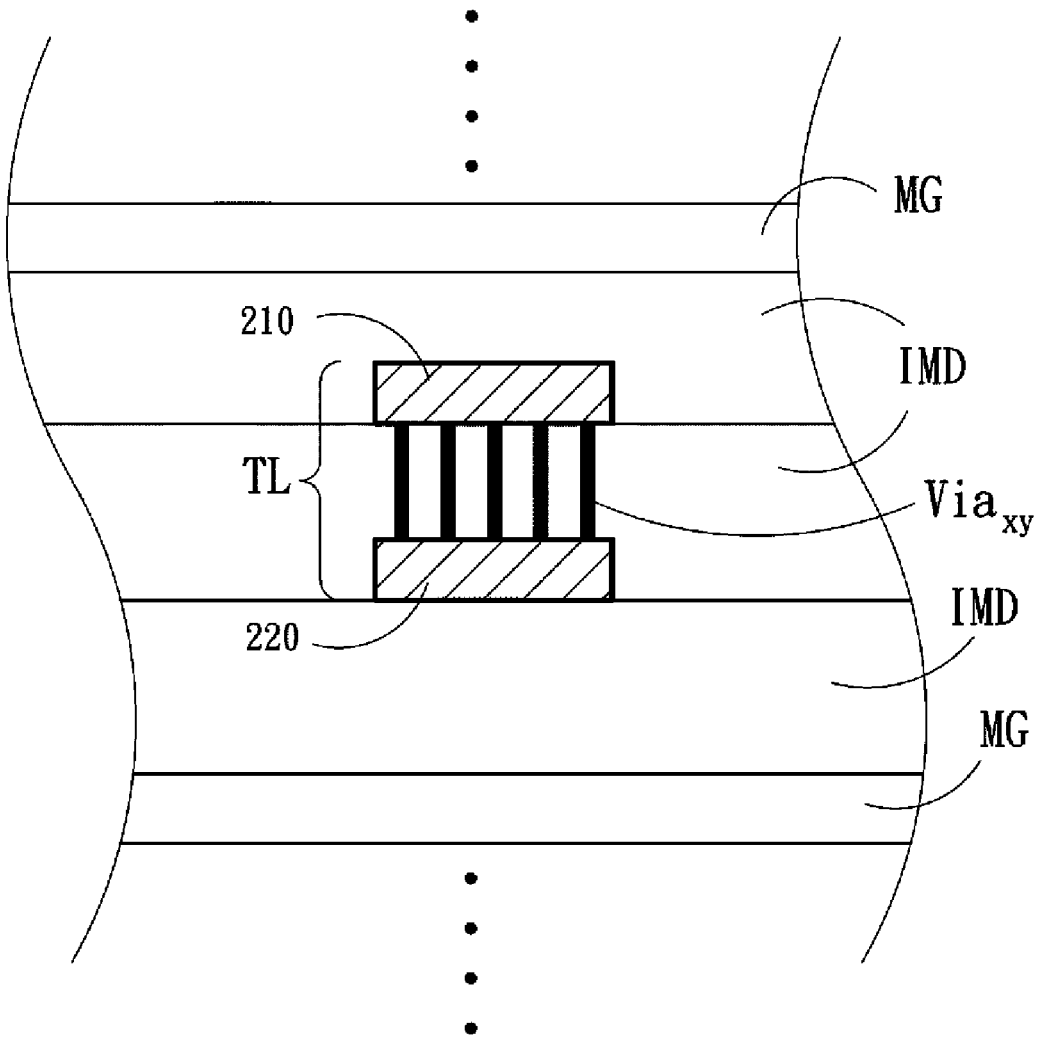
FIG. 2 illustrates the cross-sectional structure of one preferred signal transmission line embodiment in accordance with the present invention.

Referring to FIG. 2, the cross-sectional structure of one preferred signal transmission line embodiment in accordance with the present invention is illustrated. A signal transmission line TL includes two sub-signal-transmission-lines 210, 220 and a plurality of first vias $Via_{xy}$. Herein, x, y represent natural numbers and y=x+1. The two sub-signal-transmission-lines 210, 220 are two different layers of metal transmission lines in a CMOS structure. They are connected by the plurality of first vias $Via_{xy}$ to form the signal transmission line TL in order to increase the thickness of the signal transmission line in the CMOS structure. MG and IMD denote the mesh ground planes and the IMD layers, respectively. The present embodiment can be applied to the signal transmission lines $TL_2$, . . . , and $TL_n$ shown in FIG. 1 to change the character of the transmission lines.

Figure 3A:
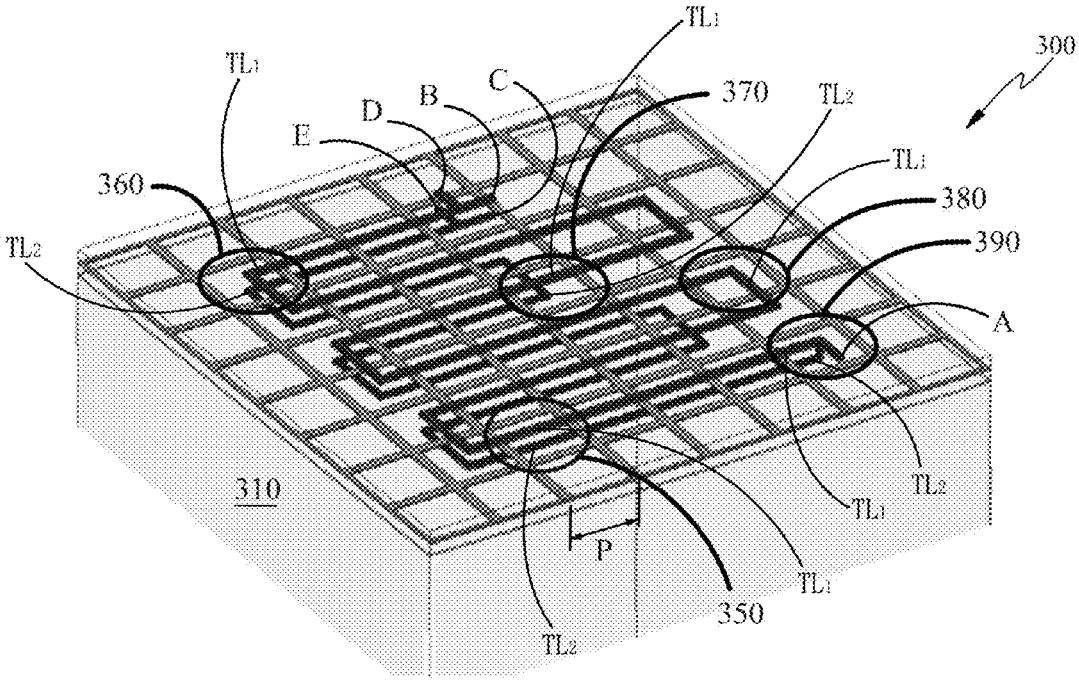
FIG. 3A shows the layout of one preferred application circuit combined by several preferred embodiments in accordance with the present invention.
Figure 3B:
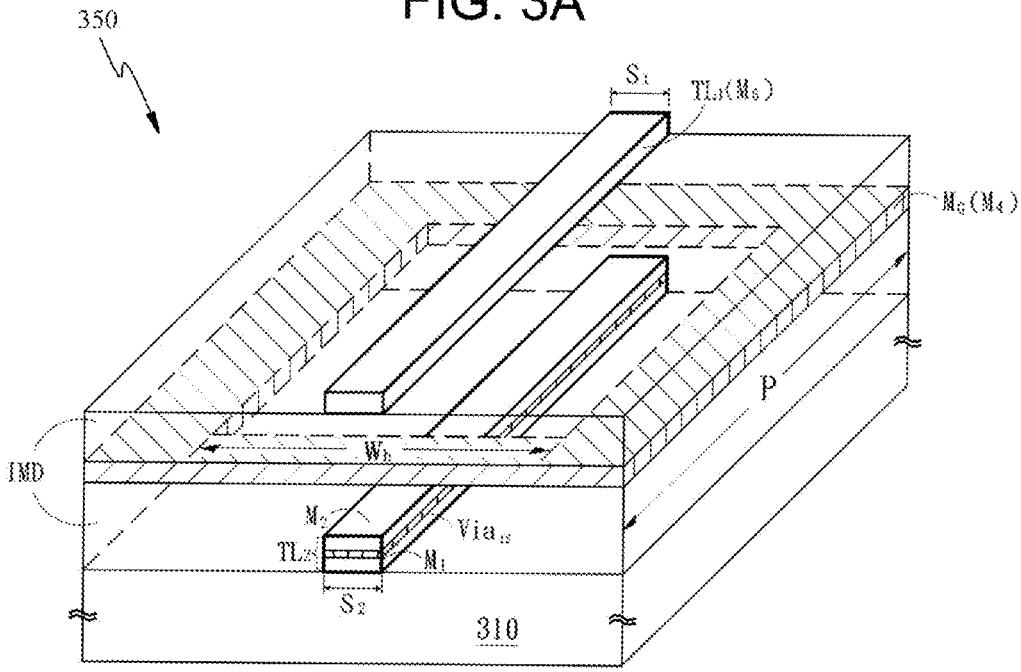
FIG. 3B illustrates the three-dimensional perspective structure of another preferred embodiment in accordance with the present invention.

Referring to FIG. 3A, the layout for one preferred application circuit 300 integrated by several preferred embodiments in accordance with the present invention is illustrated. The application circuit 300 is a Ka-band power divider designed by multilayer CCS TL structures 350, 360, 370, 380, and 390. Herein, a plurality of ends A, B, and C refer to the ports of the application circuit 300, and a connecting resistor (not shown) connects two ends D and E. Or, the ends A, D, and E are the ports of the application circuit 300, and the connecting resistor connects the ends B and C. The structure of the embodiment 350 will be described as below firstly. The embodiment 350, referring to FIG. 3B, shows the structure of the embodiment 100 depicted in FIG. 1 in case of n=2. A first signal transmission line $TL_1$ ($M_6$) with the size $S_1$ in width. A second signal transmission line $TL_2$ having the size $S_2$ in width and is parallel with the first signal transmission line $TL_1$ ($M_6$). A mesh ground plane MG ($M_4$) is between the first and the second signal transmission lines $TL_1(M_6)$ and $TL_2$. Herein, two IMD layers IMD are respectively among the mesh ground plane MG ($M_4$) and the first and the second signal transmission lines $TL_1(M_6)$ and $TL_2$ to form a stack structure. A substrate 310 has the periodicity P and is beneath the stack structure.

Herein, the second signal transmission line $TL_2$ includes two sub-signal-transmission-lines $M_1$, $M_2$ and a plurality of first vias $Via_{xy}$, such as $Via_{12}$ (similar to the transmission line structure described in FIG. 2). In a CMOS structure, the two sub-signal-transmission-lines $M_1$, $M_2$ in the present embodiment are the metal transmission lines on the first layer and on the second layer, respectively. They are connected by the plurality of first vias $Via_{12}$ to form the signal transmission line $TL_2$ in order to increase the thickness of the signal transmission line in the CMOS structure. In the present embodiment, the mesh ground plane MG ($M_4$) is the fourth metal layer and the size of the inner slot thereof is defined by mesh slot $W_h$. The first signal transmission line $TL_1(M_6)$ in the present embodiment locates on the sixth metal layer. Accordingly, the embodiment 350 is implemented in the 1P6M (one-poly-six-metal) CMOS structure.

Referring to FIG. 3A again, the embodiments 360 and 370 are similar to the embodiment 350. The differences among them are that the first and the second transmission lines $TL_1$ and $TL_2$ are straight lines in the embodiment 350, the first and the second transmission lines $TL_1$ and $TL_2$ show L-line form in the embodiment 360, and the first and the second transmission lines $TL_1$ and $TL_2$ show straight and L-shape, respectively, in the embodiment 370. Likewise, the signal transmission lines $TL_1$ and $TL_2$ could respectively be L-shape and straight. Moreover, referring to the ends B, C, D, and E, the signal transmission lines $TL_1$ and $TL_2$ also could be T-shape.

Figure 3C:
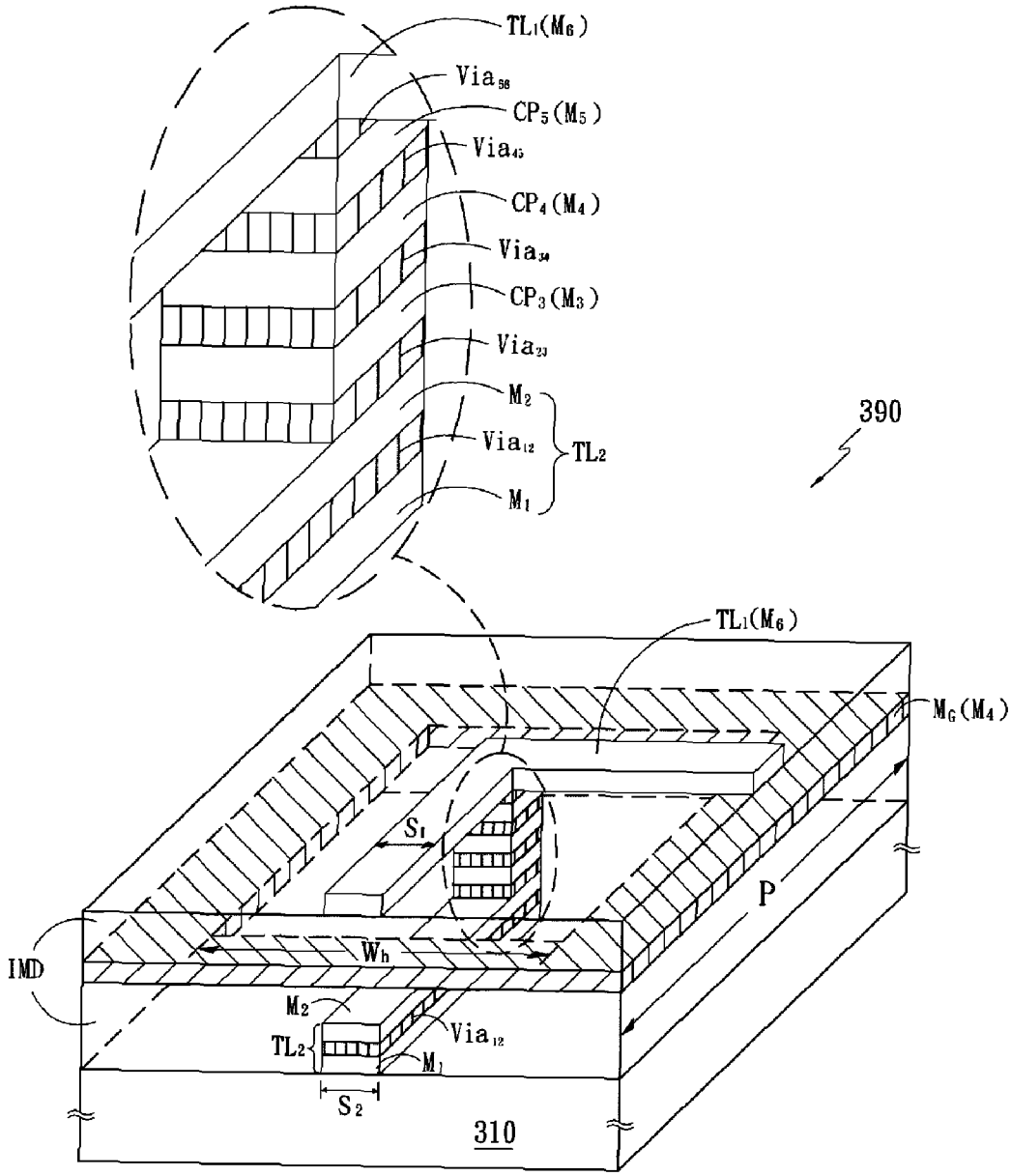
FIG. 3C illustrates the three-dimensional perspective structure of further another preferred embodiment in accordance with the present invention.

Referring to FIG. 3A again, the embodiments 380 and 390 are similar to the embodiment 350. The differences between the embodiments 350 and 380 are that the embodiment 350 has the first and the second transmission lines $TL_1$and $TL_2$being straight, but the embodiment 380 only has the first transmission line $TL_1$being L-shape (also could be straight or T-shape). The structure of the embodiment 380 will be described as below (taking the embodiment 350 for explanation). A substrate 310 has the periodicity P. A signal transmission line $TL_1$is above the substrate 310. A mesh ground plane MG is between the substrate 310 and the signal transmission lines $TL_1$. Herein, two IMD layers IMD are among the mesh ground plane MG and the substrate 310 and the signal transmission lines $TL_1$, respectively. Also, the present invention can be implemented by the structure described as below (still taking the embodiment 350 for explanation). A substrate 310 has the periodicity P. A signal transmission line $TL_2$ is on the substrate 310. A mesh ground plane MG is above the signal transmission lines $TL_2$. Herein, two IMD layers IMD are respectively between the mesh ground plane MG (FIG. 3*b*) and the signal transmission lines $TL_2$ and on the mesh ground plane MG. That is, the present embodiment only has the second signal transmission line $TL_2$ (i.e. could be straight, L-shape, or T-shape) of the embodiment 350 and its structure is the same as the second signal transmission line $TL_2$ shown in the embodiment 350, and hence this part will not be repeated here. The big difference between the embodiments 350 and 390 (referring to FIG. 3C) is that the embodiment 390 further includes a second via connecting the first and the second transmission lines $TL_1(M_6)$ and $TL_2$ ($M_1$, $M_2$ and $Via_{12}$). Herein, the second via includes a plurality of sub-vias and at least one metal layer structure. In the present embodiment, the second via at least has metal layers $CP_3$ ($M_3$), $CP_4$ ($M_4$), $CP_5$ ($M_5$), and a plurality of sub-vias $Via_{23}$, $Via_{34}$, $Via_{45}$, and $Via_{56}$ to connect the first and the second transmission lines $TL_1$ and $TL_2$ as shown in the enlarge view of FIG. 3C. Besides, the features of the first signal transmission line $TL_1$ being L-shape (also could be straight or T-shape) and the second signal transmission line $TL_2$connecting the first signal transmission line $TL_1$ through the second via in the embodiment 390 are also distinguished from the embodiment 350. As for the substrate 310, the periodicity P, the IMD layers IMD, the mesh ground plane MG ($M_4$), the mesh slot $W_h$, and the sizes $S_1$, $S_2$ respectively for the first and the second signal transmission lines $TL_1$ and $TL_2$, they are the same as those described in FIG. 3B for the embodiment 350, and thus they will not be repeated here. The features of the embodiments described above can be applied to all embodiments in accordance with the present invention and should not be used to limit the implementing thereof.

The inventor would like to emphasize that the n signal transmission lines (or as n=2, the first and the second transmission lines) can be designed for multilayer (or two-layer) independent circuits. Since the mesh ground planes provides complete grounding effect, the interference resulting from the signals on different layers can be decreased to lower the loss in signal transmission and provide much flexibility and miniaturization for circuit designs.

Figure 4A:
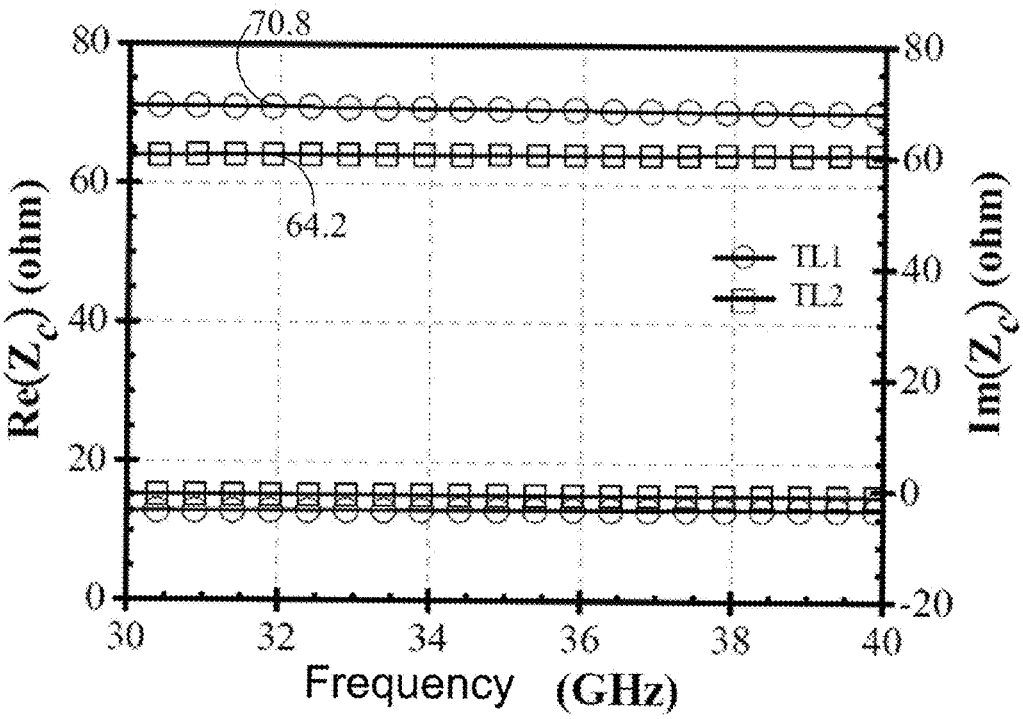
FIG. 4A shows the relation curves between the complex characteristic impedance ($Z_c$) and frequency which are extracted from one preferred embodiment in accordance with the present invention.
Figure 4B:
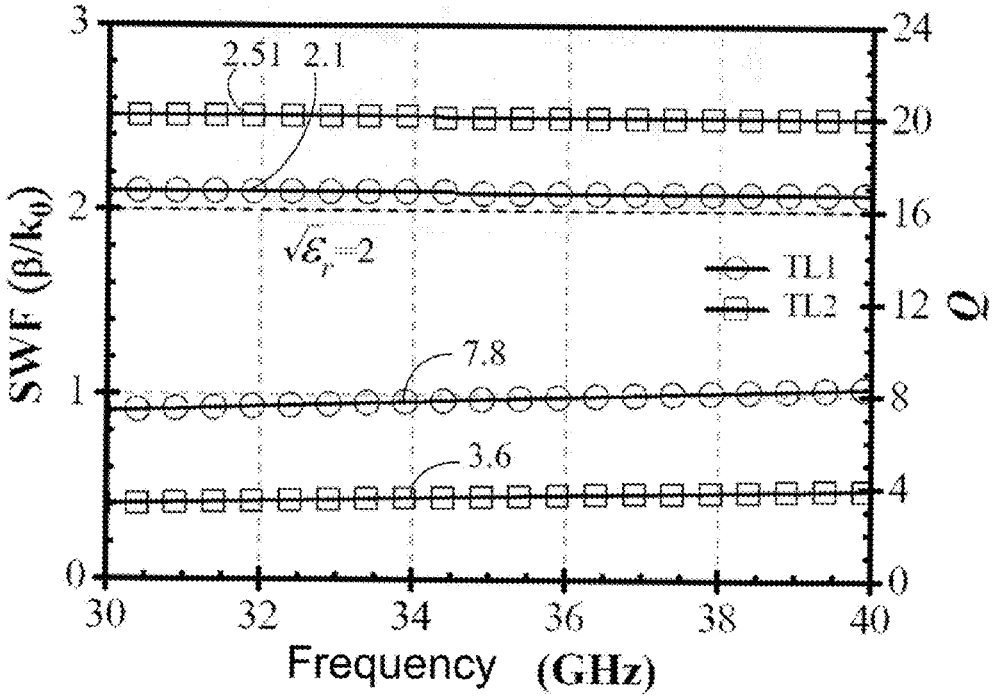
FIG. 4B shows the relation curves among the slow-wave factor (SWF), quality-factor (Q), and frequency which are extracted from one preferred embodiment in accordance with the present invention.

Referring to FIGS. 4A and 4B, the relation curves among the complex characteristic impedance ($Z_c$ in ohm) of the first and the second transmission lines and frequency in GHz which are extracted from the embodiment 350 in case of n=2, and the relation curves among the slow-wave factor (SWF) in β/ko and quality-factor (Q) of the first and the second transmission lines and frequency in GHz are shown, respectively in FIGS. 4A and 4B. The inventor would like to stress here that the related data set for simulations and the results obtained from simulations are only used to explain the simulation processes and the results of preferred embodiments in accordance with the present invention, but not limit the implementing of the present invention.

The data set for simulations is defined as below. The widths $S_1$ and $S_2$ of the transmission lines $TL_1$ and $TL_2$ are respectively 3.0 μm and 2.0 μm, and the thicknesses of the $TL_1$ ($M_6$) and $TL_2$ ($MlM_2$) are 2.0 μm and 1.95 μm, respectively. The thicknesses of IMD layers IMDs from the metal layers $M_2$ to $M_4$ and $M_4$ to $M_6$ are 2.25 μm, respectively. The relative dielectric constant of the IMD is 4.0. The periodicity P is defined as 30.0 μm. The mesh slot size $W_h$ is 26.0 μm. Moreover, the simulations are performed by the commercial software package Ansoft HFSS, and the results obtained from the simulations are shown in FIGS. 4A and 4B, respectively.

In FIG. 4A, the real parts of $Z_c$ {i.e. $Re(Z_c)$} of the first and the second transmission lines $TL_1$ and $TL_2$ at Ka-band are 70.8Ω and 64.2Ω, respectively. The imaginary parts of $Z_c$ {i.e. $Im(Z_c)$} are nearly identical. In FIG. 4B, the SWFs of the first and the second transmission lines $TL_1$ and $TL_2$ at Ka-band are 2.10 and 2.51, respectively, and the quality-factors of the first and the second transmission lines $TL_1$ and $TL_2$ at Ka-band are respectively 7.8 and 3.6. Wherein, $\sqrt{\epsilon_r}=2$ since $\epsilon_r=4$. This value is the theoretical limit of the quasi-TEM transmission line. The value represents the relative dielectric constant of the IMD.

Although specific embodiments have been illustrated and described, it will be obvious to those skilled in the art that various modifications may be made without departing from what is intended to be limited solely by the appended claims.

What is claimed is:

1. A multilayer complementary-conducting-strip transmission line structure, being formed in a complementary metal-oxide semiconductor structure, said multilayer complementary-conducting-strip transmission line structure, comprising:

a substrate; and n signal transmission lines, being parallel and interlacing with n−1 mesh ground plane(s), wherein a plurality of inter-media-dielectric layers are correspondingly stacked with among said n signal transmission lines and said n−1 mesh ground plane(s) to form a stack structure on said substrate, wherein n is a natural number and n>2, wherein, said n signal transmission lines individually comprise two sub-signal-transmission-lines and a plurality of first vias, each said two sub-signal-transmission-lines are on different metal layers of said complementary metal-oxide semiconductor structure.

2. The multilayer complementary-conducting-strip transmission line structure according to claim 1, further comprising a second via connecting said n signal transmission lines.

3. The multilayer complementary-conducting-strip transmission line structure according to claim 1, wherein said n signal transmission lines comprise straight-line form.

4. The multilayer complementary-conducting-strip transmission line structure according to claim 1, wherein said n signal transmission lines comprise L-line form.

5. The multilayer complementary-conducting-strip transmission line structure according to claim 1, wherein said n signal transmission lines comprise T-line form.

6. A multilayer complementary-conducting-strip transmission line structure, being formed in a complementary metal-oxide semiconductor structure, said multilayer complementary-conducting-strip transmission line structure, comprising:

a first signal transmission line;

a second signal transmission line, being parallel with said first signal transmission line;

a mesh ground plane, being between said first and said second signal transmission lines, wherein two inter-media-dielectric layers are sandwiched correspondingly among said mesh ground plane, said first and said second signal transmission lines to form a stack structure; and a substrate, being beneath said stack structure, wherein said second signal transmission line comprises two sub-signal-transmission-lines and a plurality of first vias, said two sub-signal-transmission-lines are on different metal layers of said complementary metal-oxide semiconductor structure.

7. The multilayer complementary-conducting-strip transmission line structure according to claim 6, further comprising a second via connecting said first and said second signal transmission lines.

8. The multilayer complementary-conducting-strip transmission line structure according to claim 6, wherein said first signal transmission line comprises straight-line form.

9. The multilayer complementary-conducting-strip transmission line structure according to claim 6, wherein said first signal transmission line comprises L-line form.

10. The multilayer complementary-conducting-strip transmission line structure according to claim 6, wherein said first signal transmission line comprises T-line form.

11. The multilayer complementary-conducting-strip transmission line structure according to claim 6, wherein said second signal transmission line comprises T-line form.

12. The multilayer complementary-conducting-strip transmission line structure according to claim 6, wherein said second signal transmission line comprises straight-line form.

13. The multilayer complementary-conducting-strip transmission line structure according to claim 6, wherein said second signal transmission line comprises L-line form.

14. A multilayer complementary-conducting-strip transmission line structure, being formed in a complementary metal-oxide semiconductor structure, said multilayer complementary-conducting-strip transmission line structure, comprising:

a substrate;

a signal transmission line, being on said substrate; and a mesh ground plane, being above said signal transmission line, wherein two inter-media-dielectric layers are respectively sandwiched between said mesh ground plane and said signal transmission line and on said mesh ground plane, wherein, said signal transmission line comprises two sub-signal-transmission-lines and a plurality of first vias, said two sub-signal-transmission-lines are on different metal layers of said complementary metal-oxide semiconductor structure.

15. The multilayer complementary-conducting-strip transmission line structure according to claim 14, wherein said signal transmission line comprises straight-line form.

16. The multilayer complementary-conducting-strip transmission line structure according to claim 14, wherein said signal transmission line comprises L-line form.

17. The multilayer complementary-conducting-strip transmission line structure according to claim 14, wherein said signal transmission line comprises T-line form.

* * * * *